US008682184B2

(12) United States Patent
Nishikawa

(10) Patent No.: US 8,682,184 B2
(45) Date of Patent: Mar. 25, 2014

(54) IMAGE FORMING APPARATUS AND METHOD OF STORING TONER REPLENISHMENT AMOUNT

(75) Inventor: Shingo Nishikawa, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 165 days.

(21) Appl. No.: 13/470,515

(22) Filed: May 14, 2012

(65) Prior Publication Data

US 2012/0294632 A1 Nov. 22, 2012

(30) Foreign Application Priority Data

May 20, 2011 (JP) ..... 2011-113070

(51) Int. Cl.
*G03G 15/08* (2006.01)

(52) U.S. Cl.
CPC ..... *G03G 15/0831* (2013.01); *G03G 15/0839* (2013.01)
USPC ..... 399/27; 399/258

(58) Field of Classification Search
CPC ..... G03G 15/0831; G03G 15/0839
USPC ..... 399/13, 27, 29, 61, 255, 258
See application file for complete search history.

(56) References Cited

U.S. PATENT DOCUMENTS 7,881,623 B2 * 2/2011 Yamaguchi ..... 399/27
8,150,277 B2 * 4/2012 Takiguchi ..... 399/27

FOREIGN PATENT DOCUMENTS

JP 2000-162925 6/2000

* cited by examiner

*Primary Examiner* — Hoang Ngo
(74) *Attorney, Agent, or Firm* — Morgan, Lewis & Bockius LLP

(57) ABSTRACT

An image forming apparatus includes: a developing unit; an intermediate hopper including a toner detector, for replenishing the developing unit with toner; a container that replenishes toner to the intermediate hopper and includes a replenishment amount storage unit for storing an accumulated toner replenishment amount; a control unit for determining whether or not the container is empty and whether or not the container has been replaced; a reader/writer for causing the replenishment amount storage unit to update the accumulated toner replenishment amount; and a storage unit for storing an integrated value of toner replenishment amounts in a container empty mode, and the reader/writer causes the replenishment amount storage unit of the container after being replaced to store the accumulated toner replenishment amount.

14 Claims, 8 Drawing Sheets

IMAGE FORMING APPARATUS AND METHOD OF STORING TONER REPLENISHMENT AMOUNT

This application is based upon and claims the benefit of priority from the corresponding Japanese Patent Application No. 2011-113070 filed on May 20, 2011, the entire contents of which are incorporated herein by reference.

FIELD

The disclosure relates to an image forming apparatus such as a multifunctional peripheral, a copier, a printer, or a FAX machine, including an intermediate hopper to be replenished with toner from a container, and a developing unit to be supplied with toner from the intermediate hopper.

BACKGROUND

Some image forming apparatus form an image with toner. A developing unit supplies toner to an image bearing member (photosensitive drum) on which an electrostatic latent image is formed, and the electrostatic latent image is developed with toner. A replaceable container (toner container, toner cartridge, etc.) for supplying replenishing toner is mounted to the image forming apparatus. When the toner in the container is used up, the container is replaced by a new one.

There is known an image forming apparatus which does not suspend a job (printing) even when a container is removed. Specifically, there is known an image forming apparatus which includes a photosensitive member for bearing an electrostatic latent image, a forming unit for forming an electrostatic latent image on the photosensitive member, a developing unit for developing the electrostatic latent image borne on the photosensitive member, a container (toner cartridge) that contains toner to be supplied to the developing unit, supplies the toner to the developing unit, and is removably mountable on an image forming apparatus main body, and a detecting unit for detecting the removal/mounting of the container. The image forming apparatus continues a print job when the detecting unit determines that the container has been removed during the print job and prompts a user to mount a container. With this configuration, the print job is not suspended even when the container is removed during the print job, and a user is prompted to mount a container.

The container may be provided with a storage element (for example, an IC tag) for storing various pieces of information. As information to be provided to the container, the storage element may store a toner replenishment amount accumulated after the container is mounted. For example, the accumulated toner replenishment amount is used for grasping a toner residual amount in the container.

Further, the image forming apparatus may be provided with an intermediate hopper that is replenished with toner from the container and supplies the toner to the developing unit. In general, the intermediate hopper stores a larger amount of toner than that stored in the developing unit. Due to the presence of the intermediate hopper, even when the toner in the container is used up, a certain number of sheets can be printed. When the amount of the toner in the intermediate hopper becomes smaller, the intermediate hopper is replenished with toner from the container.

When printing is performed through use of toner in the intermediate hopper in a state in which the intermediate hopper is not replenished with new toner during a period from a time when the container becomes empty (no toner remains in the container) to a time when the container is replaced by a new one, the toner in the intermediate hopper decreases in amount. When the container is replaced by a new one, in order to restore the toner amounts in the intermediate hopper and the developing unit, which have decreased due to the consumption of toner while the container is empty, to prescribed amounts, it is necessary to replenish the intermediate hopper and the developing unit with toner from a new container even when printing is not performed.

Therefore, even when printing is not performed at all, a part of toner may be replenished from the new container merely by replacing the old one by the new one. However, conventionally, there is a problem in that a toner replenishment amount is stored in an IC tag or the like along with the execution of a print job, and hence the toner amount consumed during a period from a time when the container becomes empty to a time when the container is replaced by the new one (the amount of toner to be supplied from a new container to the intermediate hopper merely by replacing the old one by the new one) is not counted as a toner replenishment amount. Therefore, when a toner residual amount is displayed through use of an accumulated toner replenishment amount stored in an IC tag or the like, there is also a problem in that a toner residual amount cannot be displayed precisely due to a difference from the actual residual amount of toner in the container.

In the conventional image forming apparatus, a storage element of a new container does not store a toner amount consumed while the old container is empty. Therefore, the above-mentioned problem cannot be solved. Further, as described above, some conventional image forming apparatus can perform printing even when a container is removed. However, a toner replenishment amount cannot be stored in a storage element during the removal of the container, and hence, the toner amount consumed during the removal of the container is not stored in the storage element. Therefore, there is a problem in that a difference is caused between the accumulated toner replenishment amount stored in the storage element and the amount of toner actually replenished.

SUMMARY

In view of the above-mentioned problems of the conventional technologies, according to the disclosure, a precise toner replenishment amount from a container is stored in the container and a toner residual amount of the container is obtained precisely even when printing or removal of the container is performed while the container is empty.

In order to achieve the above-mentioned object, according to a first aspect of the present disclosure, there is provided an image forming apparatus, including: a developing unit for performing development through use of toner; an intermediate hopper including a toner detector for detecting whether or not a prescribed amount of toner is present, for replenishing the developing unit with toner; a container that can be replaced, contains toner for replenishment, replenishes toner to the intermediate hopper, and includes a replenishment amount storage unit for storing an accumulated toner replenishment amount after the container is mounted to the image forming apparatus; a replenishment unit for replenishing toner from the container to the intermediate hopper; a determination unit for causing the replenishment unit to replenish toner from the container to the intermediate hopper when detecting that a toner amount in the intermediate hopper is below the prescribed amount through use of the toner detector, and determining whether or not the container is empty and whether or not the container has been replaced; a storage unit for storing an integrated value of toner replenishment amounts during a period of time from a time when the determination unit determines that the container is empty to a time when the determination unit determines that the container has been replaced; and a reader/writer that is configured to: transmit, to the replenishment amount storage unit, data indicating the toner replenishment amount from the intermediate hopper to the developing unit and cause the replenishment amount storage unit to update the accumulated toner replenishment amount; stop transmitting the data indicating the toner replenishment amount to the replenishment amount storage unit during the period of time from the time when the determination unit determines that the container is empty to the time when the determination unit determines that the container has been replaced; transmit the integrated value to the replenishment amount storage unit of the container after being replaced when the determination unit determines that the container has been replaced; and cause the replenishment amount storage unit to store the integrated value as the accumulated toner replenishment amount.

Further features and advantages of the present disclosure will become apparent from the description of embodiments given below.

DETAILED DESCRIPTION OF EMBODIMENT

Hereinafter, with reference to FIGS. 1 to 8, an embodiment of the present disclosure is described by taking a multifunctional peripheral 100 (corresponding to an image forming apparatus) as an example. However, components, layouts, and other such elements described in each embodiment do not limit the scope of the disclosure and are mere examples used for the description.

(Outline of Multifunctional Peripheral 100)

Figure 1:
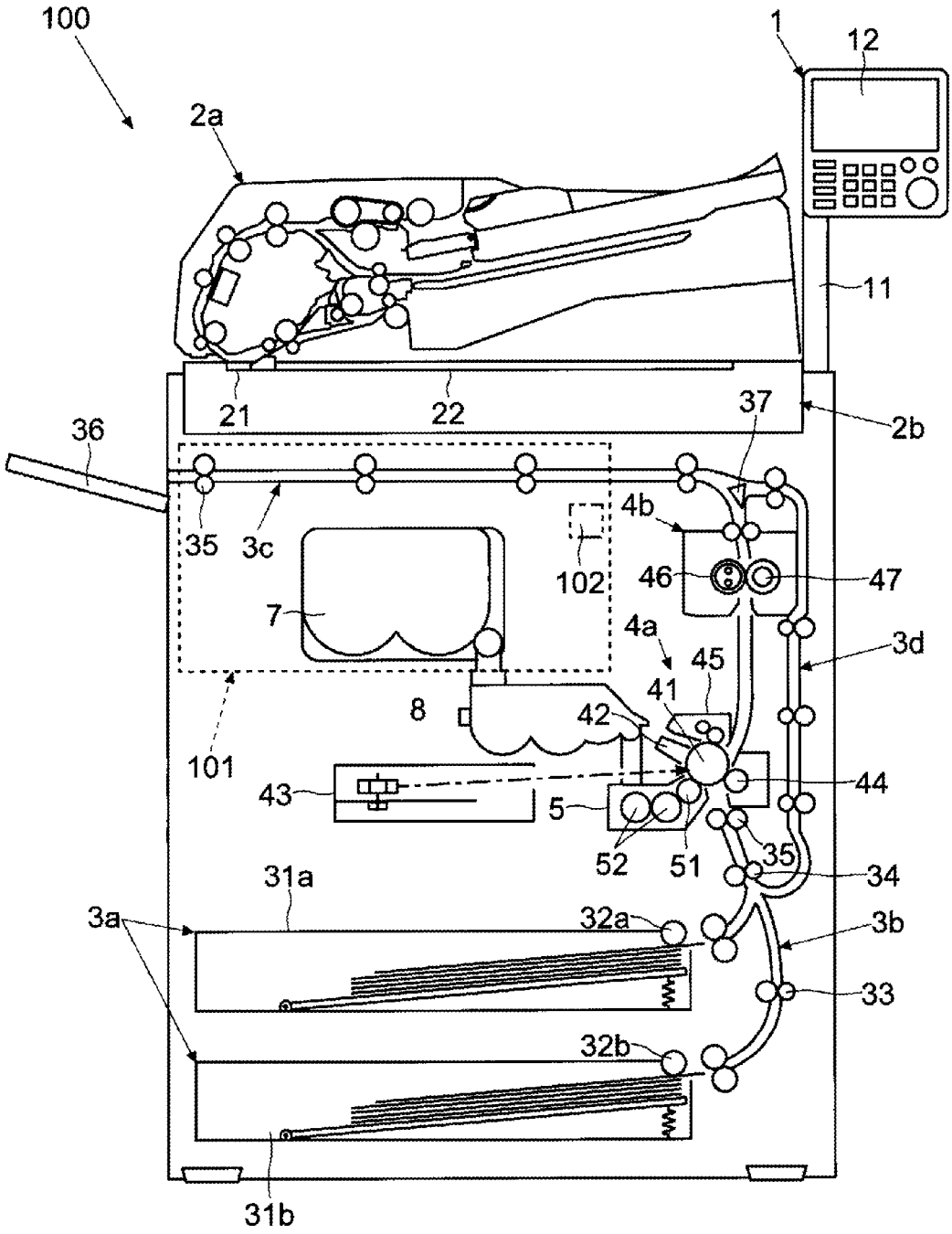
FIG. 1 is a cross-sectional front view illustrating a schematic structure of a multifunctional peripheral.

First, FIG. 1 is used to describe an outline of the image forming apparatus according to the embodiment of the present disclosure. FIG. 1 is a cross-sectional front view illustrating the schematic structure of the multifunctional peripheral 100.

As illustrated in FIG. 1, a multifunctional peripheral 100 of the embodiment includes an operation panel 1 mounted to a side surface thereof. A document conveying device 2*a* and an image reading unit 2*b* are provided in an upper portion of the multifunctional peripheral 100. Further, a sheet feeding unit 3*a*, a first conveying path 3*b*, an image forming unit 4*a*, a fixing unit 4*b*, a second conveying path 3*c*, and a duplex printing conveying path 3*d* are provided inside the multifunctional peripheral 100.

First, the operation panel 1 is provided at the tip end of an arm 11 provided on an upper right side of the multifunctional peripheral 100. The operation panel 1 includes a liquid crystal display unit 12 (corresponding to a display unit) for displaying the state of the multifunctional peripheral 100, such as an error, various messages, and a screen for setting. The liquid crystal display unit 12 is of a touch-panel type (for example, a resistant film type). The operation panel 1 functions as an operation unit for a user to set printing conditions such as the kind and size of sheets to be used for printing, enlargement/reduction, and the presence/absence of duplex printing, and for receiving an instruction to cancel a display of an error state. The operation panel 1 also functions as a notifying unit for notifying a user of the state of the apparatus, notices, an error message, etc. by displaying the notifications on the liquid crystal display unit 12.

The document conveying device 2*a* has a pivot point on the depth side of the drawing surface of FIG. 1 so as to be openable/closable in a vertical direction of the drawing surface. When documents are scanned, the document conveying device 2*a* conveys documents placed on the document conveying device 2*a* one by one to a reading position (contact glass 21 for reading in conveyance). When a document placed on a contact glass 22 for reading in placement is read, the document conveying device 2*a* functions as a cover for holding down the document.

The image reading unit 2*b* reads a document passing by the contact glass 21 for reading in conveyance or a document placed on the contact glass 22 for reading in placement to form image data of the document. Further, optical members (not shown) such as an exposure lamp, mirrors, lenses, and an image sensor (for example, a CCD) are provided in the image reading unit 2*b*.

The image reading unit 2*b* irradiates with light the document passing by the contact glass 21 for reading in conveyance or the document placed on the contact glass 22 for reading in placement with use of the optical members, and performs A/D conversion on an output value of each pixel of an image sensor having received reflected light from the document to generate image data. The multifunctional peripheral 100 can perform printing based on the image data obtained by reading (copying function).

As illustrated in FIG. 1, the sheet feeding unit 3*a* is disposed in a lower portion inside the multifunctional peripheral 100. The sheet feeding unit 3*a* includes a plurality of cassettes 31 (in FIG. 1, an upper cassette is denoted with reference symbol 31*a* and a lower cassette is denoted with reference symbol 31*b*). Each cassette 31 contains various sheets such as copying paper, an OHP sheet, and label paper. The sheet feeding unit 3*a* is provided with a sheet feed roller 32 (in FIG. 1, an upper roller is denoted with reference symbol 32*a* and the lower roller is denoted with reference symbol 32*b*). Any one of the sheet feed rollers 32 is rotated by a drive mechanism (not shown) such as a motor, and sends out a sheet to the first conveying path 3*b*.

The first conveying path 3*b* for conveying a sheet in the multifunctional peripheral 100 is provided substantially vertically along the right side surface of a main body of the multifunctional peripheral 100. The first conveying path 3*b* guides the sheet fed from the sheet feeding unit 3*a* to the image forming unit 4*a*. The first conveying path 3*b* is provided with conveying roller pairs 33, 34, a registration roller pair 35 for causing the sheet conveyed to the registration roller pair 35 to wait before the image forming unit 4*a* (transfer roller 44) and sending out the sheet at an appropriate timing, and the like.

As illustrated in FIG. 1, the multifunctional peripheral 100 includes the image forming unit 4*a* for forming a toner image based on image data of an image to be formed. The image forming unit 4*a* includes a photosensitive drum 41, and a charging unit 42, an exposure unit 43, a developing unit 5, a transfer roller 44, a cleaning unit 45, and the like provided around the photosensitive drum 41.

The photosensitive drum 41 includes a photosensitive layer on an outer circumferential surface thereof, and a circumferential surface of the photosensitive layer can bear a toner image. The photosensitive drum 41 is driven to rotate at a predetermined process speed. The charging unit 42 charges the photosensitive drum 41 at a predetermined electric potential. The exposure unit 43 outputs a laser beam (illustrated by an alternate long and short dash line) based on an image signal (image data) been input, to perform scanning exposure on the charged photosensitive drum 41 to form an electrostatic latent image on the surface of the photosensitive drum 41. The exposure unit 43 receives image data of the document having subjected to image processing via a control unit 6 and an image processing unit 62, and irradiates the photosensitive drum 41 with laser light based on the image data, thereby performing scanning exposure.

The developing unit 5 includes a developing roller 51 for bearing a thin layer of toner to be used for development, agitating rollers 52 that rotate to agitate toner in the developing unit 5, and the like. The developing unit 5 supplies toner to the photosensitive drum 41 and develops the electrostatic latent image formed on the circumferential surface of the photosensitive drum 41. The cleaning unit 45 cleans the photosensitive drum 41. The transfer roller 44 comes into pressure-contact with the photosensitive drum 41. Then, the registration roller pair 35 feeds the sheet to a nip between the photosensitive drum 41 and the transfer roller 44 in accordance with the formation of a toner image. A predetermined transfer voltage is applied to the transfer roller 44. Thus, the toner image is transferred to the sheet.

The fixing unit 4*b* is disposed on a downstream side in a sheet conveying direction relative to the image forming unit 4*a*. The fixing unit 4*b* heats and pressurizes the toner image transferred to the sheet to fix the toner image to the sheet. The fixing unit 4*b* includes a fixing roller 46 containing a heat-generation source and a pressure roller 47 which comes into pressure-contact with the fixing roller 46. The sheet with the toner image transferred thereto is heated and pressurized when passing through a nip between the fixing roller 46 and the pressure roller 47. Consequently, the toner image is fixed to the sheet. The sheet with the toner image fixed thereto is guided to the second conveying path 3*c* provided above the fixing unit 4*b*.

The sheet discharged from the fixing unit 4*b* is conveyed through the second conveying path 3*c* extending substantially horizontally from a branch unit 37 to a left side surface of the multifunctional peripheral 100. Then, the sheet is discharged, by a discharge roller pair 35, to a discharge tray 36 provided outside an upper portion of the left side surface of the multifunctional peripheral 100. Thus, image formation processing (printing processing) is completed. Note that when duplex printing is performed, the sheet discharged from the fixing unit 4*b* is temporarily sent out from the branch unit 37 toward the discharge tray 36, and thereafter, has its conveying direction switched backward toward a right side surface of the multifunctional peripheral 100. Then, the sheet passes through the branch unit 37, is sent downward through the duplex printing conveying path 3*d*, and is sent again to the registration roller pair 35 via the first conveying path 3*b* again.

(Hardware Configuration of Multifunctional Peripheral 100)

Figure 2:
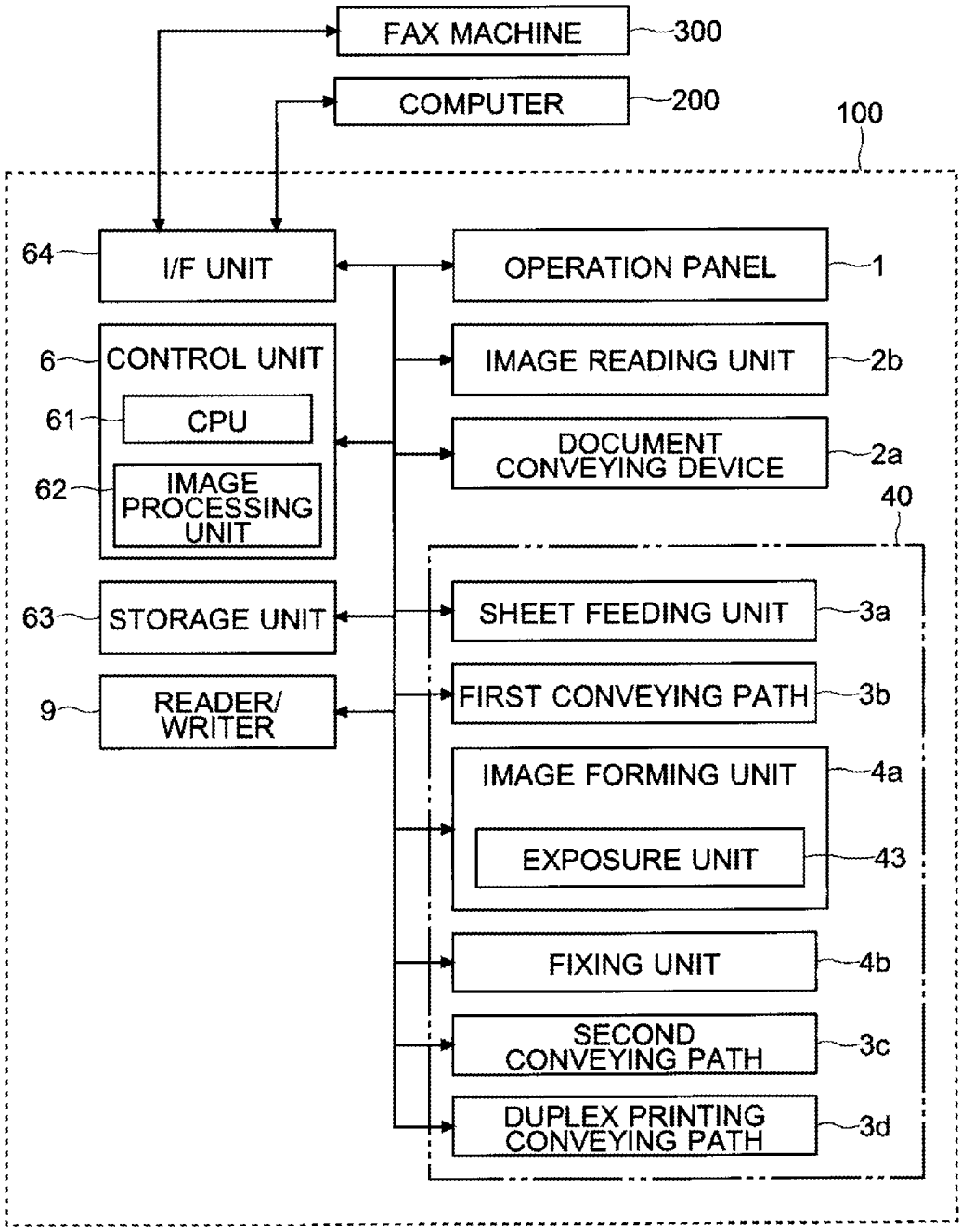
FIG. 2 is a block diagram illustrating a hardware configuration of the multifunctional peripheral.

Next, FIG. 2 is referenced to describe a hardware configuration of the multifunctional peripheral 100 according to the embodiment of the present disclosure. FIG. 2 is a block diagram illustrating the hardware configuration of the multifunctional peripheral 100.

As illustrated in FIG. 2, the multifunctional peripheral 100 according to the embodiment includes therein a control unit 6 (corresponding to a determination unit). The control unit 6 includes a CPU 61 for performing various computation processing and an image processing unit 62 for performing image processing with respect to image data. The control unit 6 causes the CPU 61 and the image processing unit 62 to perform various processing so as to control the respective components of the multifunctional peripheral 100.

The CPU 61 is a central processing unit for performing control of the respective components of the multifunctional peripheral 100 and computation based on a control program, control data, setting data, and the like stored in and loaded into the storage unit 63. The storage unit 63 is formed of a combination of nonvolatile storage devices and volatile storage devices such as a ROM, a RAM, a flash ROM, and an HDD. For example, the storage unit 63 stores a control program for the multifunctional peripheral 100, control data, and the like.

The control unit 6 is connected to the operation panel 1 and the like, and recognizes the setting input from the operation panel 1. Further, the control unit 6 is connected to the document conveying device 2*a* and the image reading unit 2*b*, and operates the document conveying device 2*a* and the image reading unit 2*b* when executing a job involving scanning so that a document is read.

The control unit 6 is also connected to an I/F unit 64. The I/F unit 64 is a communication interface for communicating to a computer 200 (personal computer, server, etc.), which serves as a transmission source of printing data containing image data to be printed and setting data for printing, or a FAX machine 300 through a network, a cable, or a public line. The I/F unit 64 receives the image data or the setting data for printing from the computer 200 or the FAX machine 300.

The image processing unit 62 performs various pieces of image processing such as enlargement, reduction, density conversion, and data format conversion on the image data of a document read by the image reading unit 2*b* or the image data based on printing data received from the computer 200 or the FAX machine 300 in accordance with the setting. When a job involving printing is executed, the image processing unit 62 transmits the image data after being subjected to image processing to the exposure unit 43. The exposure unit 43 receives the image data and performs scanning exposure (copier, printer, FAX functions). Further, the control unit 6 can transmit the image data of the document read by the image reading unit 2*b* from the I/F unit 64 to an external computer 200 or a FAX machine 300 (scanner, FAX functions).

The control unit 6 is also connected to portions (engine unit 40) for performing printing such as the sheet feeding unit 3*a*, the first conveying path 3*b*, the image forming unit 4*a*, the fixing unit 4*b*, and the second conveying path 3*c* so as to be capable of communicating with each other. The control unit 6 controls the operation of the engine unit 40 to cause the engine unit 40 to perform printing. Note that, the control unit 6 may be divided for each function into, for example, a main control unit for performing overall control, image processing, or communication control, and an engine control unit which controls printing for forming an image and turns ON/OFF a motor for rotating various rotators.

(Outline of Toner Replenishment to Developing Unit 5)

Figure 3:
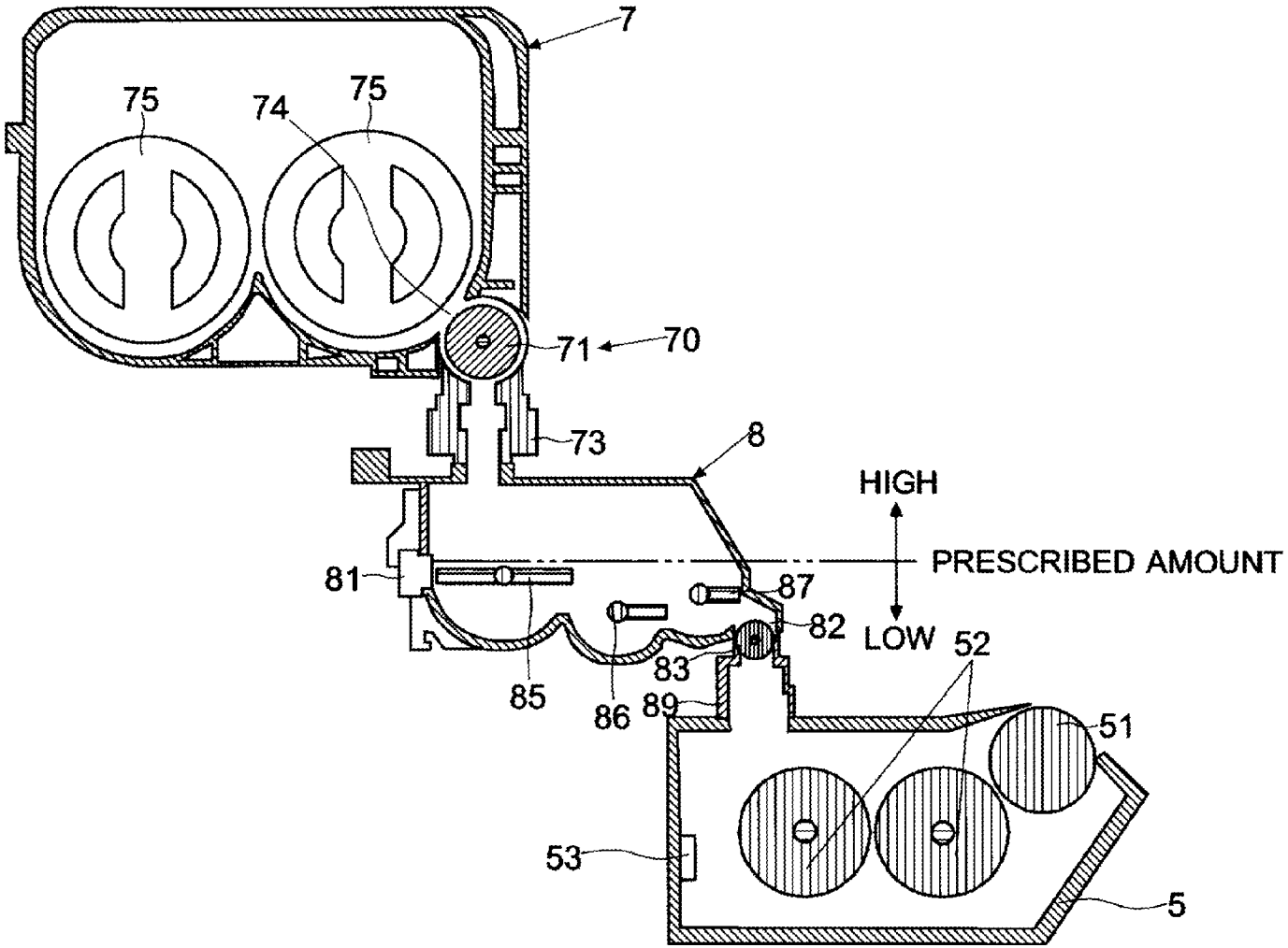
FIG. 3 is a cross-sectional view illustrating a container, an intermediate hopper, and a developing unit.

Next, the outline of toner replenishment to the developing unit 5 according to the embodiment is described with reference to FIGS. 1 and 3. FIG. 3 is a cross-sectional view illustrating a container 7, an intermediate hopper 8, and the developing unit 5.

As illustrated in FIGS. 1 and 3, the multifunctional peripheral 100 includes the container 7 and the intermediate hopper 8 so as to replenish the developing unit 5 with toner. The container 7 contains toner. The container 7 replenishes the intermediate hopper 8 with toner. The intermediate hopper 8 contains unused toner in an amount larger than that of the developing unit 5 and smaller than that of the container 7. For example, the intermediate hopper 8 contains toner in an amount capable of printing about 2,000 A4 sheets on average. The intermediate hopper 8 replenishes the developing unit 5 with toner.

As illustrated in FIG. 1, the multifunctional peripheral 100 includes a front cover 101 (corresponding to a cover) provided on the front surface thereof (the front cover 101 is illustrated by a broken line in FIG. 1). For example, the front cover 101 can be opened so that the upper end of the front cover 101 falls down to the front side of FIG. 1. A user can open the front cover 101 and mount or remove the container 7 through an opening that appears when the user opens the front cover 101. When the container 7 becomes empty, the user replaces the container 7 with a new container 7.

Figure 4:
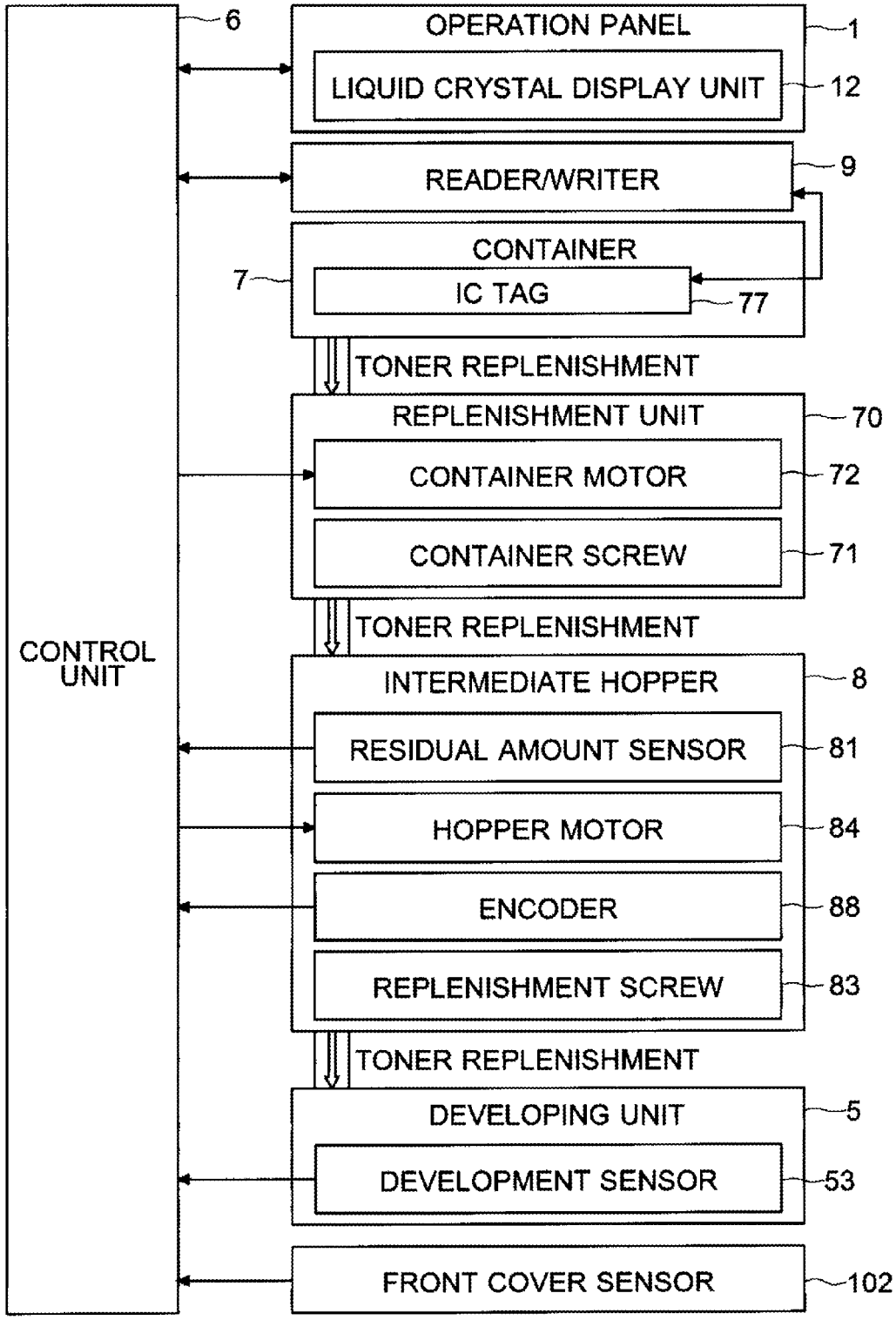
FIG. 4 is a block diagram illustrating a hardware configuration of a portion related to toner replenishment in the multifunctional peripheral.

The multifunctional peripheral 100 includes a front cover sensor 102 (corresponding to an open/close detector) for detecting the open/close of the front cover 101 provided on the front surface of the multifunctional peripheral 100 (the front cover sensor 102 is illustrated by an alternate long and two short dashes line in FIG. 1; see FIG. 4). For example, the front cover sensor 102 is an interlock switch, and an output of the front cover sensor 102 varies depending upon whether the front cover 101 is closed or opened. The control unit 6 receives an output from the front cover sensor 102, and recognizes whether the front cover 101 is opened or closed by checking the output of the front cover sensor 102. Note that, the front cover sensor 102 is not limited to the interlock switch, and may be another kind of sensor (for example, an optical sensor) as long as the open/close of the front cover 101 can be detected.

Further, in the multifunctional peripheral 100 of the embodiment, even when the front cover 101 is opened, the control unit 6 can cause the engine unit 40 to execute a print job.

(Flow of Toner Replenishment)

Next, members related to the toner replenishment in the embodiment and the basic flow of the toner replenishment are described with reference to FIGS. 3 and 4. FIG. 4 is a block diagram illustrating a hardware configuration of portions related to the toner replenishment in the multifunctional peripheral 100.

(1. Toner Replenishment from Container 7 to Intermediate Hopper 8)

First, the toner replenishment from the container 7 to the intermediate hopper 8 is described. In order to replenish toner from the container 7 to the intermediate hopper 8, a replenishment unit 70 is provided, as illustrated in FIGS. 3 and 4. The replenishment unit 70 includes a container screw 71 for receiving toner from the container 7 and replenishing the toner into the intermediate hopper 8, a container motor 72 for rotating the container screw 71, and an replenishment tube 73 for connecting the container screw 71 to a toner replenishment port of the intermediate hopper 8 so as to allow the toner to pass therethrough.

The container screw 71 is provided in a lower part of the container 7 so as to face a discharge opening 74 through which the toner in the container 7 is discharged. For example, the toner screw 71 is provided with blades in a spiral shape on a rotation shaft thereof, and rotates to replenish toner into the intermediate hopper 8 through the replenishment tube 73. When toner is replenished into the intermediate hopper 8, the control unit 6 causes the container screw 71 to rotate by causing the container motor 72 to rotate. Two agitating members 75 that rotate to agitate toner in the container 7 are provided in the container 7. The container motor 72 can also rotate the two agitating members 75.

In the intermediate hopper 8, a residual amount sensor 81 (corresponding to a toner detector) for detecting whether or not a prescribed amount of toner is present in (fills) the intermediate hopper 8 is provided. The residual amount sensor 81 is provided on the side surface of the intermediate hopper 8 so as to come into contact with the toner in the intermediate hopper 8. The residual amount sensor 81 is a piezoelectric sensor and vibrates. When a part of the residual amount sensor 81 exposed inside the intermediate hopper 8 comes into contact with the toner, the residual amount sensor 81 stops vibrating. The output of the residual amount sensor 81 varies depending upon the degree to which the vibration is stopped when the toner comes into contact with a detection surface of the residual amount sensor 81.

In FIG. 3, when the intermediate hopper 8 is filled with toner up to a level (corresponding to a prescribed amount) indicated by an alternate long and two short dashes line to such a degree that the residual amount sensor 81 comes into contact with the toner, the residual amount sensor 81 outputs High. On the other hand, in FIG. 3, when the amount of the toner in the intermediate hopper 8 becomes smaller than the level (corresponding to the prescribed amount) indicated by the alternate long and two short dashes line due to the toner replenishment to the developing unit 5, the residual amount sensor 81 outputs Low. As illustrated in FIG. 4, the control unit 6 receives an output of the residual amount sensor 81, and recognizes whether or not the amount of the toner in the intermediate hopper 8 is below the prescribed amount. When the residual amount sensor 81 outputs Low, the control unit 6 recognizes that the amount of the toner in the intermediate hopper 8 becomes smaller than the prescribed amount, and operates the replenishment unit 70 (container motor 72) to replenish toner into the intermediate hopper 8. Then, when the residual amount sensor 81 outputs High, the control unit 6 recognizes that the intermediate hopper 8 is filled with toner at least in the prescribed amount, and stops the replenishment unit 70 (container motor 72).

(2. Toner Replenishment from Intermediate Hopper 8 to Developing Unit 5)

A toner discharge port 82 connected to the developing unit 5 is provided at a lower end of the intermediate hopper 8. A replenishment screw 83 is provided at an inlet portion of the toner discharge port 82. The replenishment screw 83 is rotated by a hopper motor 84. For example, the replenishment screw 83 is provided with blades in a spiral shape on a rotation shaft thereof, and rotates to guide toner into the developing unit 5. The control unit 6 operates the hopper motor 84 to rotate the replenishment screw 83, thereby replenishing the developing unit 5 with toner. The toner is replenished from the intermediate hopper 8 to the developing unit 5 via a replenishment tube 89.

A development sensor 53 for detecting that the amount of the toner in the developing unit 5 becomes small and the developing unit 5 needs to be replenished with toner is provided in the developing unit 5. The output of the development sensor 53 is input to the control unit 6. When the control unit 6 detects that the amount of the toner in the developing unit 5 becomes small and the developing unit 5 needs to be replenished with toner based on the output of the development sensor 53, the control unit 6 operates the hopper motor 84 to replenish the developing unit 5 with toner from the intermediate hopper 8. For example, during printing, the control unit 6 operates the hopper motor 84 to replenish the developing unit 5 with toner.

The intermediate hopper 8 includes therein a first agitation paddle 85 whose height of the rotation center is substantially the same as that of the residual amount sensor 81, a second agitation paddle 86 provided on the right side of the first agitation paddle 85, and a third agitation paddle 87 provided on the right side of the second agitation paddle 86. The first agitation paddle 85 includes two agitation blades on a rotation shaft thereof. The second agitation paddle 86 and the third agitation paddle 87 respectively include one agitation blade on a rotation shaft thereof. For example, the agitation blade provided to each agitation paddle is made of a film-shaped resin in a comb shape. Each agitation paddle loosens the replenished toner. Further, each agitation paddle delivers the toner to the toner discharge port 82.

The hopper motor 84 of the intermediate hopper 8 can rotate the first agitation paddle 85, the second agitation paddle 86, and the third agitation paddle 87 as well as the replenishment screw 83. Further, the hopper motor 84 can rotate forward or backward. In a drive transmission path from the hopper motor 84 to the replenishment screw 83, for example, a clutch (not shown) for transmitting a drive force only in one rotation direction is provided (not necessary with respect to each agitation paddle). Thus, the control unit 6 allows the toner in the intermediate hopper 8 to be agitated without replenishing the developing unit 5 with toner by rotating the hopper motor 84 in a direction in which the replenishment screw 83 does not rotate.

(Memory of Toner Replenishment Amount)

Figure 5:
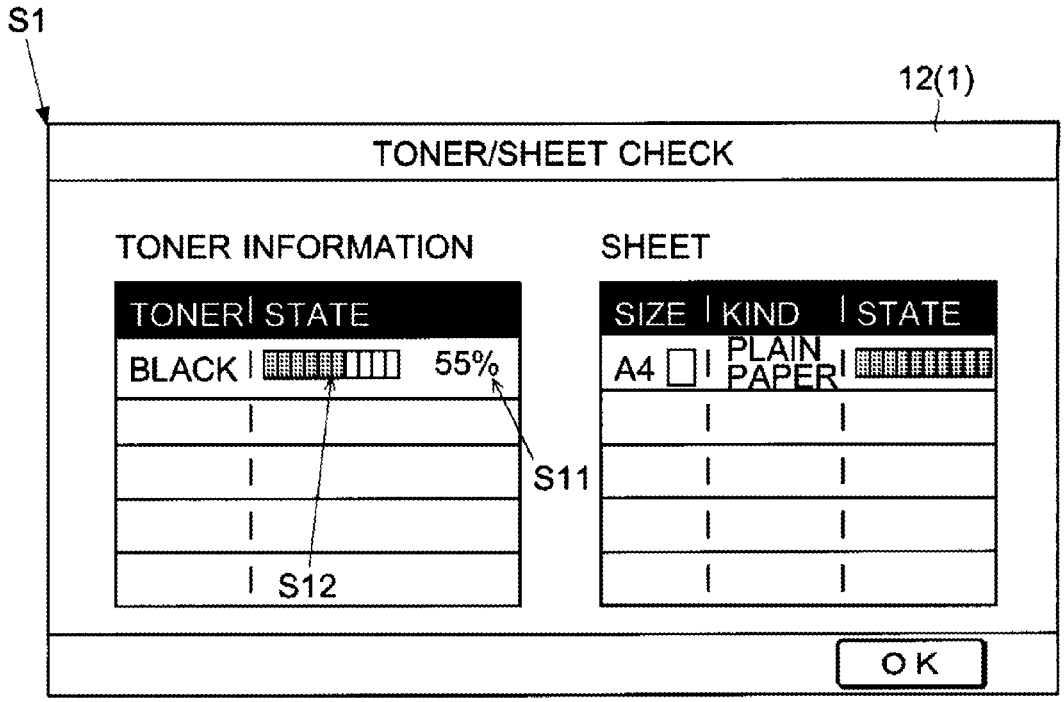
FIG. 5 is an explanatory diagram illustrating a toner residual amount display screen displayed on a liquid crystal display unit of an operation panel.

Next, the memory of a toner replenishment amount from the container 7 is described with reference to FIGS. 4 and 5. FIG. 5 is an explanatory diagram illustrating a toner residual amount display screen 51 displayed on the liquid crystal display unit 12 of the operation panel 1.

First, the container 7 is provided with an IC tag 77 (corresponding to a replenishment amount storage unit; not shown in FIG. 3). For example, the IC tag 77 includes an antenna, an IC chip such as a microcomputer, a ROM, and a RAM, and the like. The IC tag 77 can store various kinds of information. For example, the IC tag 77 can store an accumulated toner replenishment amount during a period from a time when the container 7 is mounted to the multifunctional peripheral 100 to the present time, information indicating an origin (production place) of the container 7, information indicating the type of an image forming apparatus corresponding to the container 7, and information indicating a toner capacity of the container when the container 7 is full.

A reader/writer 9 is provided at a position opposed to the IC tag 77 of the mounted container 7 inside the multifunctional peripheral 100. The reader/writer 9 transmits, to the IC tag 77, data indicating a toner replenishment amount from the intermediate hopper 8 to the developing unit 5 as occasion demands based on the instruction of the control unit 6, and updates the IC tag 77 regarding the accumulated toner replenishment amount that is an integrated value of the toner replenishment amount from a time when the container 7 is mounted to the multifunctional peripheral 100. Note that, the specification of the container 7 mounted to the multifunctional peripheral 100 is previously determined, and hence, the toner capacity of the container at a time when the container 7 is full may be stored in the storage unit 63.

In the multifunctional peripheral 100 of the embodiment, an encoder 88 is provided to the replenishment screw 83 of the intermediate hopper 8. For example, the encoder 88 generates one pulse when the replenishment screw 83 makes one rotation. Further, the replenishment screw 83 delivers a substantially constant amount of toner (for example, 10 to tens of milligrams; depends upon the type of the replenishment screw 83) to the developing unit 5 for one rotation. The toner replenishment amount from the container 7 is obtained based on the number of rotations of the replenishment screw 83.

As illustrated in FIG. 4, the output of the encoder 88 is input to the control unit 6. Consequently, the control unit 6 recognizes that the replenishment screw 83 has made one rotation and the developing unit 5 has been replenished with a predetermined amount of toner from the intermediate hopper 8. When the replenishment screw 83 makes one rotation, the control unit 6 provides an instruction to the reader/writer 9. The reader/writer 9 receives the instruction and transmits information indicating the toner replenishment amount from the intermediate hopper 8 to the developing unit 5 (for one rotation of the replenishment screw 83) to the IC tag 77. Note that, the control unit 6 may transmit data indicating the toner replenishment amount to the reader/writer 9 (for a plurality of rotations) when the replenishment screw 83 makes a plurality of rotations, instead of every time the replenishment screw 83 makes one rotation. The transmission of the data indicating the toner replenishment amount by the reader/writer 9 and the update of the accumulated toner replenishment amount of the IC tag 77 are performed at all times including a printing time.

Herein, there are various forms of data to be stored in the IC tag 77 as an accumulated toner replenishment amount. For example, the reader/writer 9 may transmit a value indicating an actual toner amount to be replenished when the replenishment screw 83 makes one rotation based on the instruction of the control unit 6, and the IC tag 77 may accumulate actual toner amounts to update the accumulated toner replenishment amount.

Alternatively, the toner replenishment amount for one rotation of the replenishment screw 83 may be previously determined, and hence, the control unit 6 may store, in the IC tag 77, the accumulated number of rotations of the replenishment screw 83 from the time when the container 7 is mounted to the multifunctional peripheral 100. In this case, the reader/writer 9 transmits data indicating the number of rotations of the replenishment screw 83 to the IC tag 77 based on the instruction of the control unit 6, and the IC tag 77 adds the number of rotations indicated by the received data to the accumulated number of rotations of the replenishment screw 83 to update the accumulated number of rotations of the replenishment screw 83. In this case, the control unit 6 multiplies the accumulated number of rotations of the replenishment screw 83 obtained from the IC tag 77 via the reader/writer 9 by the toner replenishment amount for one rotation of the replenishment screw 83 to obtain an accumulated toner replenishment amount.

Thus, when the IC tag 77 receives information indicating the toner replenishment amount from the reader/writer 9, the IC tag 77 adds (integrates) the toner replenishment amount to the accumulated toner replenishment amount up to the present time (data indicating the toner amounts replenished from the time when the container 7 is mounted up to the present time) to update the accumulated toner replenishment amount. For example, the accumulated toner replenishment amount is used for displaying the toner residual amount in the container 7. When the user performs the operation of displaying the toner residual amount of the container 7, the control unit 6 displays the residual amount display screen S1 as illustrated in FIG. 5 on the operation panel 1 (liquid crystal display unit 12).

As illustrated in FIG. 5, the control unit 6 displays the toner residual amount in the container 7 on the residual amount display screen S1. On the residual amount display screen S1, the control unit 6 displays a numerical value S11 indicating the proportion of the toner residual amount in the container 7 in steps of 1% with respect to the full capacity of the container and a residual amount gauge 512. Although there are various display methods of the residual amount gauge 512, in the example of FIG. 5, 10 scales (10% for one scale) are displayed as the residual amount gauge S12, with scales for a residual amount (displayed with a shaded area in FIG. 5) and scales for a void. Note that, the numerical value S11 indicating the proportion of the toner residual amount of the container 7 and the residual amount gauge S12 may be displayed at all times in a part of the liquid crystal display unit 12.

Specifically, for displaying a residual amount of toner, the control unit 6 causes the reader/writer 9 to communicate to the IC tag 77 to read an accumulated toner replenishment amount written in the IC tag 77. Then, the control unit 6 obtains a residual amount by subtracting the accumulated toner replenishment amount obtained via the reader/writer 9 from the toner capacity of the container at a time when the container 7 is full, and divides the residual amount by the toner capacity of the container at a time when the container 7 is full to obtain the proportion of the residual amount with respect to the full capacity of the container. Then, the control unit 6 displays the numerical value S11 indicating the proportion and the residual amount gauge S12.

(Toner Replenishment Control)

Figure 6:
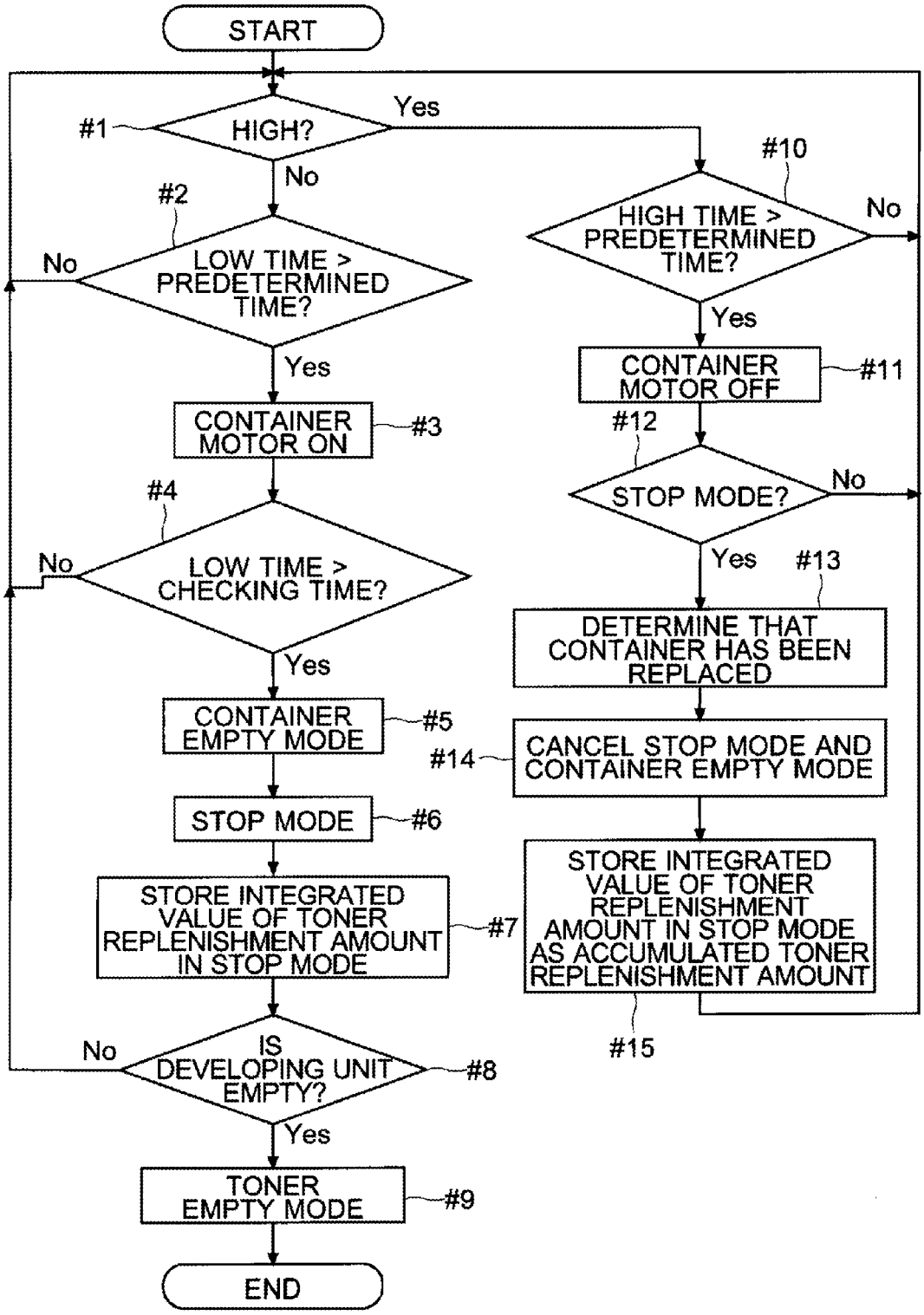
FIG. 6 is a flowchart illustrating a flow of update control of a toner replenishment amount.

Next, a flow of the toner replenishment control in the multifunctional peripheral 100 of the embodiment is described with reference to FIG. 6. FIG. 6 is a flowchart illustrating a flow of the update control of a toner replenishment amount.

At Start in FIG. 6, a main power source is turned ON, and the control unit 6 starts controlling toner replenishment. Thus, even when toner is consumed by printing, toner replenishment is controlled as occasion demands.

The control unit 6 checks the output of the residual amount sensor 81 of the intermediate hopper 8, and confirms whether or not the output of the residual amount sensor 81 is High (whether or not the toner amount in the intermediate hopper 8 is equal to or more than a prescribed amount) (Step #1). When the output of the residual amount sensor 81 is Low (No in Step #1), the control unit 6 checks whether or not Low has been detected for a period longer than a predetermined period of time (for example, 2 seconds) for avoiding erroneous detection (whether or not it has been detected that the toner amount in the intermediate hopper 8 is below the prescribed amount for a predetermined period of time or longer) (Step #2).

When Low cannot be detected for a period longer than a predetermined period of time (No in Step #2), the flow returns to Step #1 as erroneous detection (to Step #1). On the other hand, when Low can be detected for a period longer than a predetermined period of time (Yes in Step #2), the toner amount in the intermediate hopper 8 is below the prescribed amount, and hence, the control unit 6 turns ON the container motor 72 (operates the replenishment unit 70; Step #3). Thus, toner is replenished (toner is replenished) from the container 7 to the intermediate hopper 8. At this time, the container motor 72 rotates for a predetermined period of time and replenishes the intermediate hopper 8 with toner, and then, is turned OFF. Further, the control unit 6 may turn OFF the container motor 72 after an elapse of a predetermined period of time from the detection that the output of the residual amount sensor 81 becomes High.

After the replenishment unit 70 replenishes toner to the intermediate hopper 8, the control unit 6 checks whether or not the residual amount sensor 81 cannot detect the presence of a prescribed amount of toner for a period exceeding a predetermined checking period of time (for example, about 10 seconds) (whether or not it can be detected for a period equal to or longer than the checking period of time that the toner amount in the intermediate hopper 8 is below the prescribed amount although the toner is replenished to the intermediate hopper 8 after the container motor 72 is turned ON) (Step #4). In other words, as a result of operating the container motor 72 to replenish toner from the container 7 to the intermediate hopper 8, the control unit 6 checks whether or not the prescribed amount or more of toner is present in the intermediate hopper 8 (the toner amount in the intermediate hopper 8 is restored). When the output of the residual amount sensor 81 becomes High during the checking period of time (when the toner amount in the intermediate hopper 8 changes to the prescribed amount or more; No in Step #4), the flow returns to Step #1.

On the other hand, when the output of the residual amount sensor 81 remains Low for a period equal to or longer than the checking period of time (when the toner amount in the intermediate hopper 8 remains below the prescribed amount; Yes in Step #4), even when toner is replenished from the container 7, the amount of toner in the intermediate hopper 8 is not increased. Then, the control unit 6 determines that the container 7 is empty (container empty), and sets the mode of the multifunctional peripheral 100 in a container empty mode (Step #5). When the mode becomes the container empty mode, the control unit 6 may cause the operation panel 1 (liquid crystal display unit 12) to display the container empty so as to prompt the user to replace the container 7.

The control unit 6 sets a stop mode for stopping the transmission of data indicating the toner replenishment amount from the reader/writer 9 to the IC tag 77 (Step #6). Thus, the reader/writer 9 does not transmit data indicating the toner replenishment amount, and the update of the accumulated toner replenishment amount to the IC tag 77 is stopped. Further, the control unit 6 starts integrating the toner replenishment amounts based on the number of rotations of the replenishment screw 83 in the stop mode, and causes the storage unit 63 to store the integrated value (Step #7).

Then, the control unit 6 checks whether or not the developing unit 5 (intermediate hopper 8) is empty (Step #8). The multifunctional peripheral 100 of the embodiment can perform printing through use of the toner in the intermediate hopper 8 even in the container empty mode. However, when printing is performed continuously without replacing the container 7, the toner in the intermediate hopper 8 and the developing unit 5 is used up finally. When printing is performed (development is performed) in a state in which the toner in the developing unit 5 is used up, the developing unit 5 may be damaged. Therefore, the control unit 6 checks whether or not the developing unit 5 (intermediate hopper 8) is empty (Step #8). When the developing unit 5 is empty, the intermediate hopper 8 is also considered to be empty.

The control unit 6 may determine whether or not the developing unit 5 (intermediate hopper 8) is empty based on the output of the developing sensor 53 for detecting the toner amount in the developing unit 5. For example, when control unit 6 continues to detect by the developing sensor 53 that the amount of toner in the developing unit 5 is small even in the case where the replenishment screw 83 is rotated (the developing unit 5 is replenished with toner from the intermediate hopper 8), the control unit 6 recognizes developing unit empty.

Alternatively, the control unit 6 may determine whether or not the developing unit 5 is empty based on the number of printed sheets in the container empty mode. For example, in the multifunctional peripheral 100 of the embodiment, about 2,000 A4 sheets can be printed on average with toner in the intermediate hopper 8 even in the container empty mode. When damages to the developing unit 5 are considered, it is preferred not to use up the toner in the intermediate hopper 8 in some cases. Therefore, the control unit 6 may recognize the developing unit empty when a limited number of sheets smaller than the number of printing that can be performed with the toner in the intermediate hopper 8 (for example, a half i.e., about 1,000) is printed after the mode becomes the container empty mode.

When the control unit 6 recognizes the developing unit empty (Yes in Step #8), the control unit 6 sets the mode of the multifunctional peripheral 100 in the toner empty mode (Step #9→End) considering that the toner does not remain in the multifunctional peripheral 100 (almost no toner remains in the intermediate hopper 8 and the developing unit 5).

Further, when the mode becomes the toner empty mode, the control unit 6 prevents the multifunctional peripheral 100 from performing printing until the container 7 is replaced and the amount of toner in the intermediate hopper 8 is restored to the prescribed amount or more. Thus, in the toner empty mode, even when the execution of a print job is instructed, the developing unit 5 does not perform a development operation and the image forming unit 4*a*, the fixing unit 4*b* and each conveying path are not operated. Further, in the toner empty mode, the control unit 6 may cause the liquid crystal display unit 12 of the operation panel 1 to perform a display prompting the user to replace the container 7 because printing cannot be performed due to the absence of toner. An example of the toner replenishment control in the toner empty mode is described later. On the other hand, when the control unit 6 recognizes that the developing unit is not empty (No in Step #8), the flow returns to Step #1. Note that, it has already been determined that the container7 is empty, and hence, the flow may return to Step #7.

When the output of the residual amount sensor 81 is High (Yes in Step #1) in the check of whether or not the output of the residual amount sensor 81 is High (the toner amount in the intermediate hopper 8 is equal to or more than the prescribed amount) in Step #1, the control unit 6 checks whether or not High can be detected for a period longer than a predetermined period of time (for example, 2 seconds) for avoiding erroneous detection (whether or not it is detected that the toner amount in the intermediate hopper 8 is the prescribed amount or more for a predetermined period of time or longer) (Step #10).

When High cannot be detected for a period longer than the predetermined period of time (for example, 2 seconds) (No in Step #10), the flow returns to Step #1 as erroneous detection (to Step #1). On the other hand, when High can be detected (Yes in Step #10) for a period longer than the predetermined period of time (for example, 2 seconds) (Yes in Step #10), a sufficient amount of toner is present in the intermediate hopper 8, and hence, the control unit 6 turns OFF (stops) the container motor 72 when the container motor 72 (replenishment unit 70) is operated (Step #11).

Then, the control unit 6 checks whether or not the mode is the stop mode due to the container empty (Step #12). When the mode is not the stop mode (No in Step #12), the flow returns to Step #1.

On the other hand, when the mode is the stop mode (Yes in Step #12), the toner amount in the intermediate hopper 8 is restored to the prescribed amount or more after the state becomes the container empty, and hence, the control unit 6 determines that the container 7 has been replaced by a new one (Step #13). Further, the control unit 6 cancels the stop mode and the container empty mode (returns to a normal state) (Step #14). Until the mode becomes the stop mode again after the cancel of the stop mode, the control unit 6 causes the reader/writer 9 to update the accumulated toner replenishment amount in accordance with the number of rotation of the replenishment screw 83 with respect to the IC tag 77.

Further, the control unit 6 causes the reader/writer 9 to transmit to the IC tag 77 an integrated value of the toner replenishment amount stored in the storage unit 63 based on the number of rotations of the replenishment screw 83 in the stop mode (until the container 7 is replaced after the mode becomes the container empty mode). Then, the reader/writer 9 causes the IC tag 77 to store the integrated value as the accumulated toner replenishment amount (Step #15). After that, the flow returns to Step #1, for example.

(Control in Toner Empty Mode)

Figure 7:
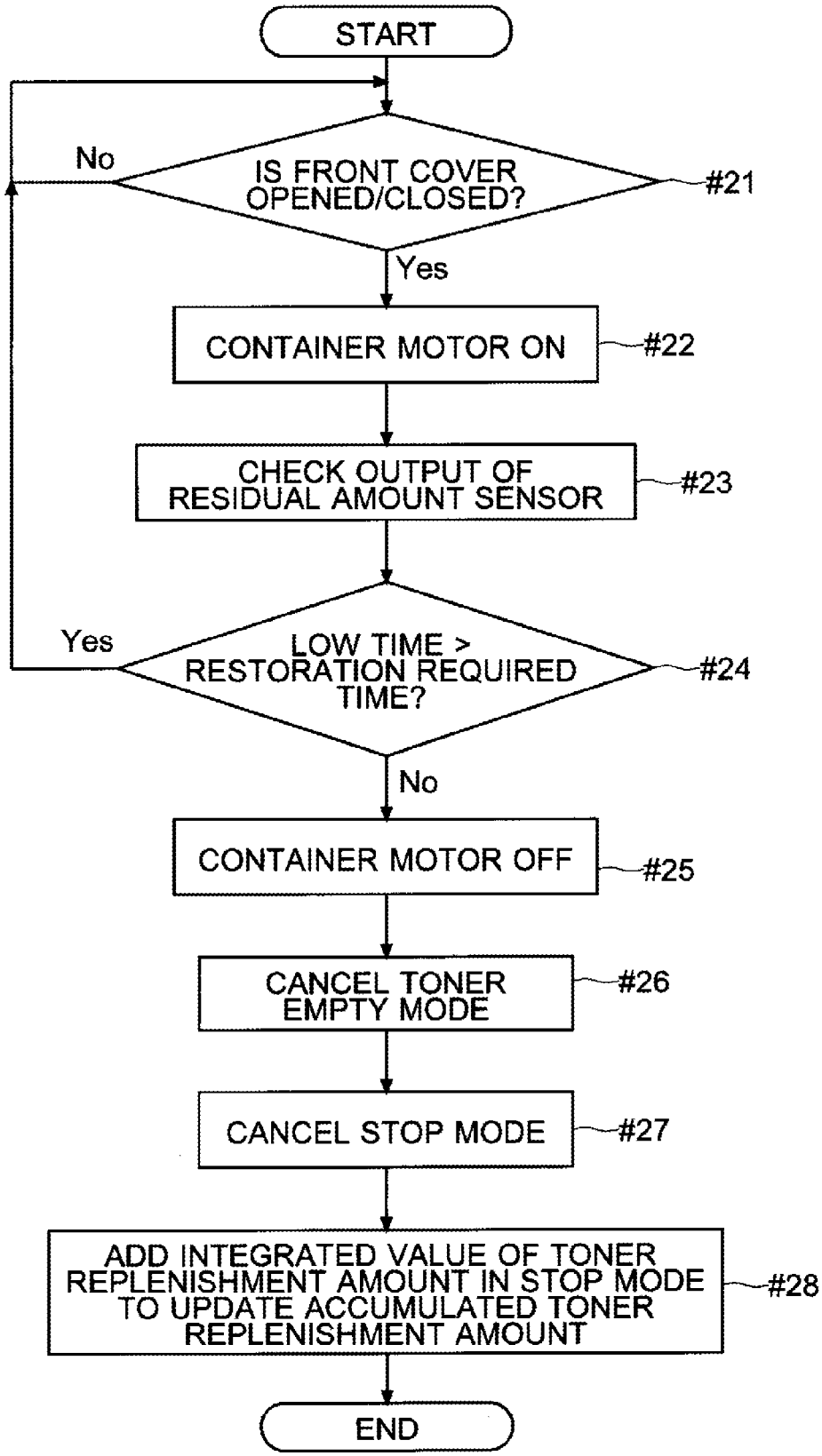
FIG. 7 is a flowchart illustrating a flow of control in a toner empty mode.

Next, a flow of the control in a toner empty mode in the multifunctional peripheral 100 of the embodiment is described with reference to FIG. 7. FIG. 7 is a flowchart illustrating a flow of the control in the toner empty mode.

At Start in FIG. 7, the amount of the toner in the developing unit 5 (intermediate hopper 8) becomes small, and the control unit 6 sets the mode of the multifunctional peripheral 100 in the toner empty mode (Step #11 in FIG. 6). In the toner empty mode, for example, the control unit 6 checks whether or not the container 7 has been replaced as a trigger of opening/closing the front cover 101. Then, the control unit 6 continues to check whether the front cover 101 has been opened/closed based on the output of the front cover sensor 102 (loop of Step #21→No in Step #21→Step #21).

When the front cover 101 is opened/closed (Yes in Step #21), the control unit 6 turns ON the container motor 72 (the replenishment unit 70 is operated; Step #22). Further, the control unit 6 checks the output of the residual amount sensor 81 (Step #23). Further, the control unit 6 checks whether or not a period of time during which the residual amount sensor 81 is Low after the control unit 6 turns ON the container motor 72 exceeds a predetermined restoration required period of time (Step #24).

Herein, the restoration required period of time refers to a period of time required for toner to fill the intermediate hopper 8 in a prescribed amount after toner starts being replenished to the intermediate hopper 8 in the toner empty state, with a slight margin added thereto (for example, about several seconds to 10 seconds). For example, the restoration required period of time may be a period of time obtained by dividing the toner amount to be replenished from the toner empty state to the prescribed amount by the toner replenishment ability per unit time from the replenishment unit 70 to the intermediate hopper 8, with a margin added thereto. Further, the restoration required period of time may be determined based on an experiment of determining how long toner should be replenished from the toner empty state so that the toner amount in the intermediate hopper 8 reaches the prescribed amount. In other words, the restoration required period of time is an index of a period of time required for replenishing toner in the prescribed amount to the intermediate hopper 8 in the toner empty state.

Even in the case where the restoration required period of time is exceeded, when the residual amount sensor 81 continues to output Low (when it is not recognized that the toner in the intermediate hopper 8 has increased to the prescribed amount; Yes in Step #24), it is not recognized that the container 7 has been replaced even when the front cover 101 is opened/closed, and hence, the flow returns to Step #21. When the flow returns to Step #21, the control unit 6 may turn OFF the container motor 72. On the other hand, when the residual amount sensor 81 outputs High before the restoration required period of time is exceeded (No in Step #24), the control unit 6 turns OFF the container motor 72 (stops the container motor 72; Step #25) and cancels the toner empty mode (Step #26).

When the residual amount sensor 81 outputs High after the mode becomes the toner empty mode, it is considered that a new container 7 is mounted by replacement and the toner amount in the intermediate hopper 8 has been restored to the prescribed amount. Then, the control unit 6 cancels the stop mode (Step #27). Along with the cancel of the stop mode, the control unit 6 causes the reader/writer 9 to transmit the toner replenishment amount in accordance with the number of rotations of the replenishment screw 83 in the stop mode and causes the IC tag 77 to store the toner replenishment amount as the accumulated toner replenishment amount (Step #28).

Specifically, the control unit 6 causes the reader/writer 9 to transmit the integrated value of the toner replenishment amounts stored in the storage unit 63 based on the rotations of the replenishment screw 83 in the stop mode (from the container empty mode to the toner empty mode). At this time, the value of the accumulated toner replenishment amount of the IC tag 77 is "0" because of the replacement of the container 7, and hence, the reader/writer 9 causes the IC tag 77 to store the integrated value as the accumulated toner replenishment amount (Step #28). After that, the flow is ended, and the update control of the toner replenishment amount is started with respect to the IC tag 77 according to the flowchart of FIG. 6.

(Update Control of Accumulated Toner Replenishment Amount when Front Cover 101 is Opened)

Figure 8:
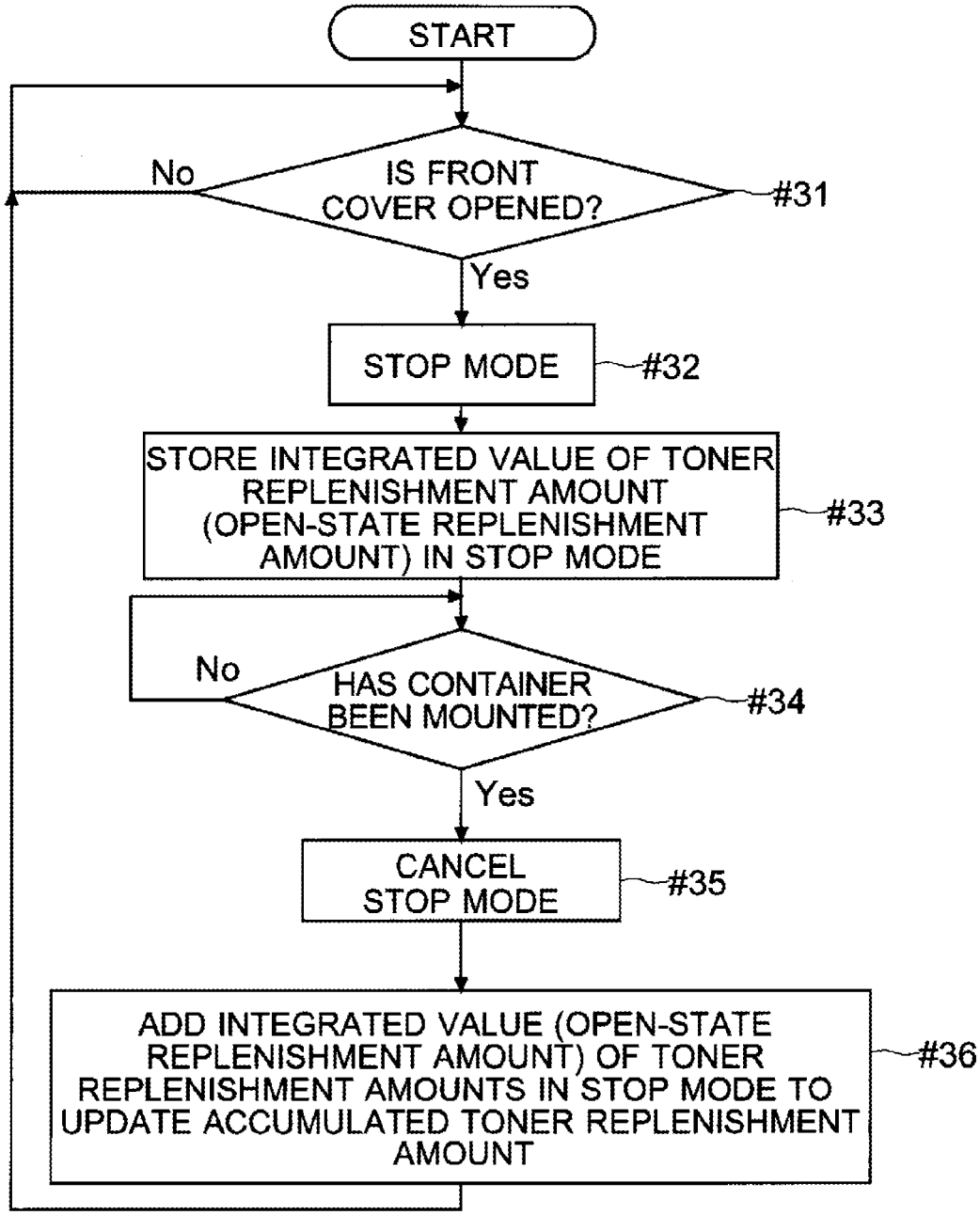
FIG. 8 is a flowchart illustrating a flow of update control of an accumulated toner replenishment amount when a front cover is opened.

Next, a flow of the update control of an accumulated toner replenishment amount when the multifunctional peripheral 100 of the embodiment is not in a container empty mode is described with reference to FIG. 8. FIG. 8 is a flowchart illustrating a flow of the update control of the accumulated toner replenishment amount when the front cover 101 is opened in the state in which the multifunctional peripheral 100 is not in the container empty mode.

When the mode is not the stop mode of the container empty, the control unit 6 causes the reader/writer 9 to update the accumulated toner replenishment amount from the intermediate hopper 8 to the developing unit 5 with respect to the IC tag 77 in accordance with the number of rotations of the replenishment screw 83 of the intermediate hopper 8 based on the output from the encoder 88. However, when the front cover 101 is opened, there is a possibility that the container 7 has been removed. When the container 7 has been removed, the accumulated toner replenishment amount cannot be updated in the IC tag 77. Consequently, a difference is caused between the accumulated toner replenishment amount stored in the IC tag 77 and the actual toner replenishment amount, and a toner residual amount cannot be displayed precisely.

When the front cover 101 is opened, the control unit 6 sets the stop mode of stopping the transmission of data indicating the toner replenishment amount from the reader/writer 9 to the IC tag 77 and causes the storage unit 63 to store the integrated value (open-state replenishment amount) of the toner replenishment amount temporarily. For example, when the cover is closed, the reader/writer 9 transmits the open-state replenishment amount to the IC tag 77. Then, the reader/writer 9 causes the IC tag 77 to add the open-state replenishment amount to the accumulated toner replenishment amount (add the toner replenishment amounts in the stop mode to the accumulated toner replenishment amount at a time) to update the toner replenishment amount.

The flowchart of FIG. 8 illustrates an interrupt process when the front cover 101 is opened in the flowchart illustrated in FIG. 6. In other words, in a normal state that is not a container empty mode or a toner empty mode, the control unit 6 always monitors the open/close of the front cover 101 and performs the process as illustrated in FIG. 8 when the front cover 101 is opened.

First, at Start in FIG. 8, power is turned ON, and the mode is not a container empty mode or a toner empty mode (stop mode). At this time, the control unit 6 controls toner replenishment. First, the control unit 6 checks the output of the front cover sensor 102 to check whether or not the front cover 101 is opened (Step #31). When the front cover 101 is not opened (No in Step #31), the flow returns to Step #31.

On the other hand, when the front cover 101 is opened, the control unit 6 sets a stop mode of stopping the transmission of data indicating a toner replenishment amount from the reader/writer 9 to the IC tag 77 (Step #32). Further, the control unit 6 does not rotate the container motor 72 until the control unit 6 determines that the front cover 101 has been closed (Yes in Step #34 described later) after the front cover 101 is opened. This is because it is not clear whether or not the container 7 has been mounted to the multifunctional peripheral 100. Thus, the reader/writer 9 does not transmit the data indicating the toner replenishment amount to the IC tag 77, and the update of the accumulated toner replenishment amount to the IC tag 77 is stopped. Further, the control unit 6 starts integrating the toner replenishment amounts based on the number of rotations of the replenishment screw 83 in the stop mode and causes the storage unit 63 to store the integrated value (open-state replenishment amount (Step #33).

Then, the control unit 6 checks whether or not the container 7 has been mounted to the multifunctional peripheral 100 (Step #34). In Step #34, the control unit 6 may determine that the container 7 has been mounted to the multifunctional peripheral 100 by recognizing that the front cover 101 has been closed based on the output of the front cover sensor 102. Alternatively, in Step #34, the control unit 6 may determine that the container 7 has been mounted to the multifunctional peripheral 100 by recognizing that the front cover 101 has been closed based on the output of the front cover sensor 102 and that toner has been replenished to the intermediate hopper 8 to change the output of the residual amount sensor 81 from Low to High.

When the control unit 6 cannot confirm that the container 7 has been mounted (No in Step #34), the control unit 6 continues to check whether the container 7 has been mounted (loop in Step #34). During the check, toner replenishment amounts in the storage unit 63 are accumulated as occasion demands (therefore, in the case of No in Step #34, the flow may return to Step #33). On the other hand, when the control unit 6 can confirm that the container 7 has been mounted (Yes in Step #34), the control unit 6 cancels the stop mode based on the open state of the front cover 101 (return to a normal state) (Step #35). The control unit 6 causes the reader/writer 9 to transmit, to the IC tag 77, the integrated value (open-state replenishment amount) of the toner replenishment amounts stored in the storage unit 63 based on the number of rotations of the replenishment screw 83 in the stop mode based on the open state of the front cover 101. Then, the reader/writer 9 causes the IC tag 77 to add the open-state replenishment amount to the accumulated toner replenishment amount to update the accumulated toner replenishment amount (Step #36). After that, the flow returns to Step #31, for example.

Thus, the image forming apparatus (the multifunctional peripheral 100) of the embodiment includes the developing unit 5 for developing an image with toner, the intermediate hopper 8 having the toner detector (residual amount sensor 81) for detecting whether or not a prescribed amount of toner is present, for replenishing the developing unit 5 with toner, the container 7 that can be replaced, contains toner for replenishment, replenishes toner to the intermediate hopper 8, and includes the replenishment amount storage unit (IC tag 77) for storing an accumulated toner replenishment amount after the container 7 is mounted to the image forming apparatus (the multifunctional peripheral 100), the replenishment unit 70 for replenishing toner from the container 7 to the intermediate hopper 8, the determination unit (control unit 6) for causing the replenishment unit 70 to replenish toner from the container 7 to the intermediate hopper 8 when detecting that the toner amount in the intermediate hopper 8 is below the prescribed amount through use of the toner detector, and determining whether or not the container 7 is empty and whether or not the container 7 has been replaced, the storage unit 63 for storing an integrated value of toner replenishment amounts during a period of time from a time when the determination unit determines that the container 7 is empty to a time when the determination unit determines that the container 7 has been replaced (during the container empty mode from a time of the determination of container empty to the determination of the replacement of the container 7 and the stop mode), and the reader/writer 9 that is configured to transmit, to the replenishment amount storage unit, data indicating the toner replenishment amount from the intermediate hopper 8 to the developing unit 5 and cause the replenishment amount storage unit to update the accumulated toner replenishment amount, stop transmitting the data indicating the toner replenishment amount to the replenishment amount storage unit during the period of time from the time when the determination unit determines that the container 7 is empty to the time when the determination unit determines that the container 7 has been replaced (during the toner empty mode and the stop mode), transmit the integrated value to the replenishment amount storage unit of the container 7 after being replaced when the determination unit determines that the container 7 has been replaced, and cause the replenishment amount storage unit to store the integrated value as the accumulated toner replenishment amount.

When the container 7 is replaced, in order to restore the toner amount in the intermediate hopper 8, which has been reduced by printing from the container empty state to the replacement of the container 7, to the prescribed amount, toner may be replenished from the container 7 to the developing unit 5 even without printing. However, in the multifunctional peripheral 100 of the embodiment, the accumulated toner replenishment amount including the toner amount to be replenished from the new container 7 to the intermediate hopper 8 merely by replacement of the container 7 without printing is stored in the replenishment amount storage unit. Therefore, the replenishment amount of toner from the container 7 can be stored in the replenishment amount storage unit precisely.

Further, the image forming apparatus (the multifunctional peripheral 100) includes the cover (front cover 101) to be opened when the container 7 is replaced and an open/close detector (front cover sensor 102) for detecting open/close of the cover. The storage unit 63 stores the open-state replenishment amount that is an integrated value of the toner replenishment amounts during a period of time from a time when the cover is opened to a time when the cover is closed, which are detected by using the open/close detector, while the determination unit (control unit 6) does not determine that the container 7 is empty. The reader/writer 9 is further configured to stop transmitting the data indicating the toner replenishment amount to the replenishment amount storage unit (IC tag 77) while the cover is opened, and transmit the open-state replenishment amount to the replenishment amount storage unit when the cover is closed, thereby causing the replenishment amount storage unit to add the open-state replenishment amount to the accumulated toner replenishment amount to update the accumulated toner replenishment amount.

When the cover (front cover 101) is opened, the container 7 may be removed even in the case where the container 7 is not empty. While the container 7 is removed, the toner replenishment amount cannot be written in the replenishment amount storage unit (IC tag 77). Therefore, the replenishment amount of toner from the container 7 cannot be stored in the replenishment amount storage unit precisely. However, according to the multifunctional peripheral 100 of the embodiment, after the cover is closed and the container 7 is not removed, the toner replenishment amount while the cover is opened can be written in the replenishment amount storage unit precisely. Therefore, the toner replenishment amount while the container 7 is removed can be prevented from being written in the replenishment amount storage unit, and the toner replenishment amount from the container 7 can be stored in the replenishment amount storage unit precisely.

Further, the image forming apparatus (the multifunctional peripheral 100) includes the display unit (liquid crystal display unit 12) for displaying a residual amount of toner in the container 7, and the display unit displays the residual amount of toner in the container 7 based on the accumulated toner replenishment amount read from the replenishment amount storage unit (IC tag 77) by the reader/writer 9 and the toner capacity of the container at a time when the container 7 is in a predetermined full state. Thus, a precise toner residual amount can be displayed based on the precise replenishment amount of toner from the container 7.

Further, the determination unit (control unit 6) determines that the container 7 is empty, when a period of time during which the toner detector (residual amount sensor 81) cannot detect the presence of a prescribed amount of toner exceeds a predetermined checking period of time (for example, about 10 seconds) after the replenishment unit 70 began replenishment operation for the intermediate hopper 8. Thus, it is determined that the container 7 is empty based on the actual phenomenon that the toner amount in the intermediate hopper 8 does not increase even when toner is replenished from the container 7. Consequently, it can be detected precisely that the container 7 is empty. Further, a sensor for measuring the toner amount in the container 7 directly is not required, and the production cost of the image forming apparatus (the multifunctional peripheral 100) can be reduced.

The determination unit (control unit 6) determines that the container 7 has been replaced when the toner detector (residual amount sensor 81) detects the presence of a prescribed amount of toner due to the toner replenishment to the intermediate hopper 8 after the determination unit determines that the container 7 is empty. Thus, it is determined whether or not the container 7 has been replaced based on the actual increase in toner amount in the intermediate hopper 8 due to the toner replenishment from the container 7. Consequently, the replacement of the container 7 can be detected precisely. Further, a sensor for detecting the replacement of the container 7 is not required, and a production cost of the image forming apparatus (the multifunctional peripheral 100) can be reduced.

Further, the determination unit (control unit 6) prohibits the developing unit 5 from performing development, when the number of sheets printed after the determination unit determines that the container 7 is empty exceeds a predetermined limited number of sheets. When the container 7 is empty, printing can be continued through use of toner in the intermediate hopper 8. However, when the amount of toner in the intermediate hopper 8 is reduced, the toner replenishment to the developing unit 5 becomes likely to be suspended. When the development is continued despite the reduction in toner in the developing unit 5, the developing unit 5 may be damaged. However, according to the image forming apparatus of the embodiment, even when the amount of toner in the developing unit 5 is reduced, the damages to the developing unit 5 caused by performing a development operation can be avoided.

Further, the developing unit 5 includes the development sensor 53 for detecting that the amount of toner in the developing unit 5 becomes small and the toner replenishment is required. The determination unit (control unit 6) prohibits the developing unit 5 from performing development, when the determination unit continues to detect, by using the development sensor 53, that the amount of toner in the developing unit is small even in a case where the intermediate hopper continues replenishment operation for the developing unit. The damages to the developing unit 5 can also be prevented through use of the development sensor 53, even when development is continued in spite of the fact that the amount of toner in the intermediate hopper 8 and the developing unit 5 becomes small.

The embodiment of the present disclosure has been described above, but the scope of the present disclosure is not limited thereto, and various modifications can be made to the implementation thereof without departing from the gist of the disclosure.

What is claimed is:

1. An image forming apparatus, comprising:

a developing unit for performing development through use of toner;

an intermediate hopper including a toner detector for detecting whether or not a prescribed amount of toner is present, for replenishing the developing unit with the toner;

a container that can be replaced, contains toner for replenishment, replenishes the toner to the intermediate hopper, and includes a replenishment amount storage unit for storing an accumulated toner replenishment amount after the container is mounted to the image forming apparatus;

a replenishment unit for replenishing toner from the container to the intermediate hopper;

a determination unit for causing the replenishment unit to replenish the toner from the container to the intermediate hopper when detecting that a toner amount in the intermediate hopper is below the prescribed amount through use of the toner detector, and determining whether or not the container is empty and whether or not the container has been replaced;

a storage unit for storing an integrated value of toner replenishment amounts during a period of time from a time when the determination unit determines that the container is empty to a time when the determination unit determines that the container has been replaced; and a reader/writer that is configured to:

transmit, to the replenishment amount storage unit, data indicating the toner replenishment amount from the intermediate hopper to the developing unit and cause the replenishment amount storage unit to update the accumulated toner replenishment amount;

stop transmitting the data indicating the toner replenishment amount to the replenishment amount storage unit during the period of time from the time when the determination unit determines that the container is empty to the time when the determination unit determines that the container has been replaced;

transmit the integrated value to the replenishment amount storage unit of the container after being replaced when the determination unit determines that the container has been replaced; and cause the replenishment amount storage unit to store the integrated value as the accumulated toner replenishment amount.

2. An image forming apparatus according to claim 1, further comprising:

a cover to be opened when the container is replaced; and an open/close detector for detecting open/close of the cover, wherein the storage unit stores an open-state replenishment amount that is an integrated value of the toner replenishment amounts during a period of time from a time when the cover is opened to a time when the cover is closed, which are detected by using the open/close detector, while the determination unit does not determine that the container is empty, and wherein the reader/writer is further configured to:

stop transmitting the data indicating the toner replenishment amount to the replenishment amount storage unit while the cover is opened; and transmit the open-state replenishment amount to the replenishment amount storage unit when the cover is closed, thereby causing the replenishment amount storage unit to add the open-state replenishment amount to the accumulated toner replenishment amount to update the accumulated toner replenishment amount stored in the replenishment amount storage unit.

3. An image forming apparatus according to claim 1, further comprising a display unit for displaying a residual amount of toner in the container, wherein the display unit displays the residual amount of toner in the container based on the accumulated toner replenishment amount read from the replenishment amount storage unit by the reader/writer and a toner capacity of the container at a time when the container is in a predetermined full state.

4. An image forming apparatus according to claim 1, wherein the determination unit determines that the container is empty, when a period of time during which the toner detector cannot detect the presence of a prescribed amount of toner exceeds a predetermined checking period of time after the replenishment unit began replenishment operation for the intermediate hopper.

5. An image forming apparatus according to claim 1, wherein the determination unit determines that the container has been replaced when the determination unit detects the presence of a prescribed amount of toner due to the toner replenishment to the intermediate hopper by using the toner detector after the determination unit determines that the container is empty.

6. An image forming apparatus according to claim 1, wherein the determination unit prohibits the developing unit from performing development, when a number of sheets printed after the determination unit determines that the container is empty exceeds a predetermined limited number of sheets.

7. An image forming apparatus according to claim 1, wherein the developing unit includes a development sensor for detecting that an amount of toner in the developing unit becomes small and toner replenishment is required, and wherein the determination unit prohibits the developing unit from performing development, when the determination unit continues to detect, by using the development sensor, that the amount of toner in the developing unit is small even in a case where the intermediate hopper continues replenishment operation for the developing unit.

8. A method of storing a toner replenishment amount, comprising:

performing development with toner by a developing unit;

replenishing the developing unit with the toner from an intermediate hopper;

detecting whether or not a prescribed amount of toner is present in the intermediate hopper;

replenishing the toner from a container that can be replaced and contains toner for replenishment to the intermediate hopper;

causing a replenishment amount storage unit provided in the container to store an accumulated toner replenishment amount after the container is mounted to an image forming apparatus;

replenishing the toner from the container to the intermediate hopper when detecting that a toner amount in the intermediate hopper is below the prescribed amount;

determining whether or not the container is empty and whether or not the container has been replaced;

causing a storage unit to store an integrated value of the toner replenishment amounts during a period of time from a time when it is determined that the container is empty to a time when it is determined that the container has been replaced;

transmitting, to the replenishment amount storage unit, data indicating the toner replenishment amount from the intermediate hopper to the developing unit and causing the replenishment amount storage unit to update the accumulated toner replenishment amount;

stop transmitting the data indicating the toner replenishment amount to the replenishment amount storage unit during the period of time from the time when it is determined that the container is empty to the time when it is determined that the container has been replaced;

transmitting the integrated value to the replenishment amount storage unit of the container after being replaced when it is determined that the container has been replaced; and causing the replenishment amount storage unit to store the integrated value as the accumulated toner replenishment amount.

9. A method of storing a toner replenishment amount according to claim 8, comprising:

detecting open/close of a cover to be opened when the container is replaced;

causing the storage unit to store an open-state replenishment amount that is an integrated value of the toner replenishment amounts during a period of time from a time when the cover is opened to a time when the cover is closed while it is not determined that the container is empty;

stop transmitting the data indicating the toner replenishment amount to the replenishment amount storage unit while the cover is opened;

transmitting the open-state replenishment amount to the replenishment amount storage unit when the cover is closed; and causing the replenishment amount storage unit to add the open-state replenishment amount to the accumulated toner replenishment amount to update the accumulated toner replenishment amount.

10. A method of storing a toner replenishment amount according to claim 8, further comprising displaying a residual amount of toner in the container based on the accumulated toner replenishment amount read from the replenishment amount storage unit and a toner capacity of the container at a time when the container is in a predetermined full state.

11. A method of storing a toner replenishment amount according to claim 8, wherein it is determined that the container is empty, when a period of time during which the presence of a prescribed amount of toner cannot be detected exceeds a predetermined checking period of time after beginning of replenishment operation of the toner to the intermediate hopper.

12. A method of storing a toner replenishment amount according to claim 8, wherein it is determined that the container has been replaced when it is detected that a prescribed amount of toner is present due to the toner replenishment to the intermediate hopper after it is determined that the container is empty.

13. A method of storing a toner replenishment amount according to claim 8, further comprising prohibiting the developing unit from performing development, when a number of sheets printed after it is determined that the container is empty exceeds a predetermined limited number of sheets.

14. A method of storing a toner replenishment amount according to claim 8, further comprising:

detecting that an amount of toner in the developing unit becomes small and toner replenishment is required; and prohibiting the developing unit from performing development, when it is continuously detected that the amount of toner in the developing unit is small even in a case where the intermediate hopper continues replenishment operation for the developing unit.

* * * * *